US007936245B2

(12) United States Patent
Huang et al.

(10) Patent No.: US 7,936,245 B2
(45) Date of Patent: May 3, 2011

(54) STACKED STRUCTURE OF A SPIRAL INDUCTOR

(75) Inventors: Kai-Yi Huang, Taipei (TW); Yuh-Sheng Jean, Yun-Lin Hsien (TW); Ta-Hsun Yeh, Hsin-Chu (TW)

(73) Assignee: Realtek Semiconductor Corp., Science Park, HsinChu (TW)

( * ) Notice: Subject to any disclaimer, the term of this patent is extended or adjusted under 35 U.S.C. 154(b) by 0 days.

(21) Appl. No.: 12/773,024

(22) Filed: May 4, 2010

(65) Prior Publication Data

US 2010/0295648 A1 Nov. 25, 2010

(30) Foreign Application Priority Data

May 19, 2009 (TW) ..... 98116543 A

(51) Int. Cl.
*H01F 5/00* (2006.01)

(52) U.S. Cl. ..... 336/200

(58) Field of Classification Search ..... 336/65, 336/200, 206–208, 232, 192; 257/531
See application file for complete search history.

(56) References Cited

U.S. PATENT DOCUMENTS 4,816,784 A * 3/1989 Rabjohn ..... 333/24 R
6,355,535 B2 * 3/2002 Liou ..... 438/381
6,426,267 B2 * 7/2002 Liou ..... 438/319
6,664,882 B2 12/2003 Andoh
6,967,555 B2 11/2005 Yu
7,039,381 B2 5/2006 Yang
7,091,814 B2 8/2006 Kyriazidou
7,525,407 B2 * 4/2009 Lee et al. ..... 336/200
7,656,264 B2 * 2/2010 Hsu et al. ..... 336/223
7,721,414 B2 * 5/2010 Sia et al. ..... 29/602.1
2008/0074229 A1 3/2008 Moinian

OTHER PUBLICATIONS

Design,Simulation and Applications of Inductors and Transformers for SI RF ICS, Ali M. Niknejad and Robert G. Meyer, 2000, p. 22-24,Kluwer Academic Publishers, Distributors for North, Central and South America.

* cited by examiner

*Primary Examiner* — Tuyen Nguyen
(74) *Attorney, Agent, or Firm* — Winston Hsu; Scott Margo

(57) ABSTRACT

A stacked structure of a spiral inductor includes a first metal layer, a second metal layer, a first set of vias, and a second set of vias. The first metal layer includes a first segment, a second segment, and a third segment, wherein the layout direction of the third segment is different from the layout direction of the first and second segments. The second metal layer includes a fourth segment, a fifth segment, and a sixth segment connected to the fifth segment, wherein the layout direction of the sixth segment is different from the layout direction of the fourth and fifth segments. The first set of vias connects the first and fourth segments, and they construct a first shunt winding. The second set of vias connects the second and fifth segments, and they construct a second shunt winding. The third and sixth segments construct a crossover region.

20 Claims, 14 Drawing Sheets

STACKED STRUCTURE OF A SPIRAL INDUCTOR

BACKGROUND OF THE INVENTION

1. Field of the Invention

The present invention relates to a stacked structure of a spiral inductor, and more particularly, to a stacked structure for improving quality factor by making use of metal layers of a crossover region as shunt windings.

2. Description of the Prior Art

As IC manufacturing processes are developing with a trend for system on chip (SOC) design, passive elements such as integrated inductors or integrated transformers have been widely integrated in high-frequency integrated circuits. Since IC manufacturing processes usually adopt a structure with Silicon-based substrates, substrate loss and metal loss of the integrated inductors/integrated transformers will affect their quality factor. And more particularly, metal loss is the main cause that most immediately affects the inductor properties.

Recently common integrated inductors consist of symmetric inductors and non-symmetric inductors. Most of them adopt the top metal layer (or the top two metal layers) as a winding of the inductor, and use the next metal layer as well as vias as a crossover region. Such inductor has the following disadvantages, that is: its parasitic resistor will be restricted by the single metal layer, a conductivity of the crossover region, a number of the vias, and the resistance of the vias. In order to improve the quality factor of the inductor, increasing widths of the winding is required. However, this approach will occupy more chip area. Hence, a structure with multiple metal layers in parallel is proposed, such as in the US patent with patent No. 2008/0074229 and the U.S. Pat. No. 6,664,882 proposed in the prior art, such that the inductor can have a lower series resistance than a traditional single-layer inductor so as to improve its quality factor. However, no matter the structure with a single metal layer or the structure with multiple metal layers in parallel are concerned, the metal layers of their crossover regions of the inductor are different from the metal layers of the windings. For this reason, the quality factor of the inductor cannot be optimized.

SUMMARY OF THE INVENTION

It is one of the objectives of the present invention to provide a stacked structure of a spiral inductor to solve the above-mentioned problems.

According to an embodiment of the present invention, a stacked structure of a spiral inductor is provided. The stacked structure of the spiral inductor includes a first metal layer, a second metal layer, a first set of vias, and a second set of vias. The first metal layer includes a first segment, a second segment, and a third segment being connected to the first segment, wherein a layout direction of the third segment is different from a layout direction of the first segment and a layout direction of the second segment. The second metal layer is positioned under the first metal layer. The second metal layer includes a fourth segment, a fifth segment, and a sixth segment being connected to the fifth segment, wherein a layout direction of the sixth segment is different from a layout direction of the fourth segment and a layout direction of the fifth segment. The first set of vias connects the first segment with the fourth segment. The second set of vias connects the second segment with the fifth segment. Herein the first segment, the fourth segment, and the first set of vias construct a first shunt winding; the second segment, the fifth segment, and the second set of vias construct a second shunt winding; and the third segment and the sixth segment construct a crossover region. The spiral inductor may be a symmetric spiral inductor.

According to another embodiment of the present invention, a stacked structure of a spiral inductor is provided. The stacked structure of the spiral inductor includes a first metal layer, a second metal layer, a first set of vias, and a second set of vias. The first metal layer includes a first segment, a second segment, and a third segment, wherein the third segment is connected to the first segment and the second segment, and is positioned between the first segment and the second segment. The second metal layer includes a fourth segment, a fifth segment, and a sixth segment, wherein the sixth segment is positioned between the fourth segment and the fifth segment. The first set of vias connects the first segment with the fourth segment. The second set of vias connects the second segment and the fifth segment. Herein the first segment and the fourth segment construct a first shunt winding; the second segment and the fifth segment construct a second shunt winding; and the third segment and the sixth segment construct a crossover region. The spiral inductor may be a non-symmetric spiral inductor.

These and other objectives of the present invention will no doubt become obvious to those of ordinary skill in the art after reading the following detailed description of the preferred embodiment that is illustrated in the various figures and drawings.

DETAILED DESCRIPTION

In the following embodiment, three kinds of stacked structures of spiral inductors with multiple stacked metal layers are provided in the light of symmetric spiral inductors (as is referenced by the embodiments shown in FIG. 1~FIG. 8) and non-symmetric spiral inductors (as is referenced by the embodiments shown in FIG. 9~FIG. 14). These stacked structures are mainly divided into an L-shape crossover structure, an interdigitated crossover structure, and a trench-shape crossover structure, such that the spiral inductor with multiple stacked metal layers can obtain an optimum quality factor. Herein the terms like "the L-shape crossover structure", "the interdigitated crossover structure", and "the trench-shape crossover structure" defined in the present invention are used for distinguishing names only. What's more, a stacked guard ring is proposed in the present invention in order to improve the noise-blocking ability.

Figure 1:
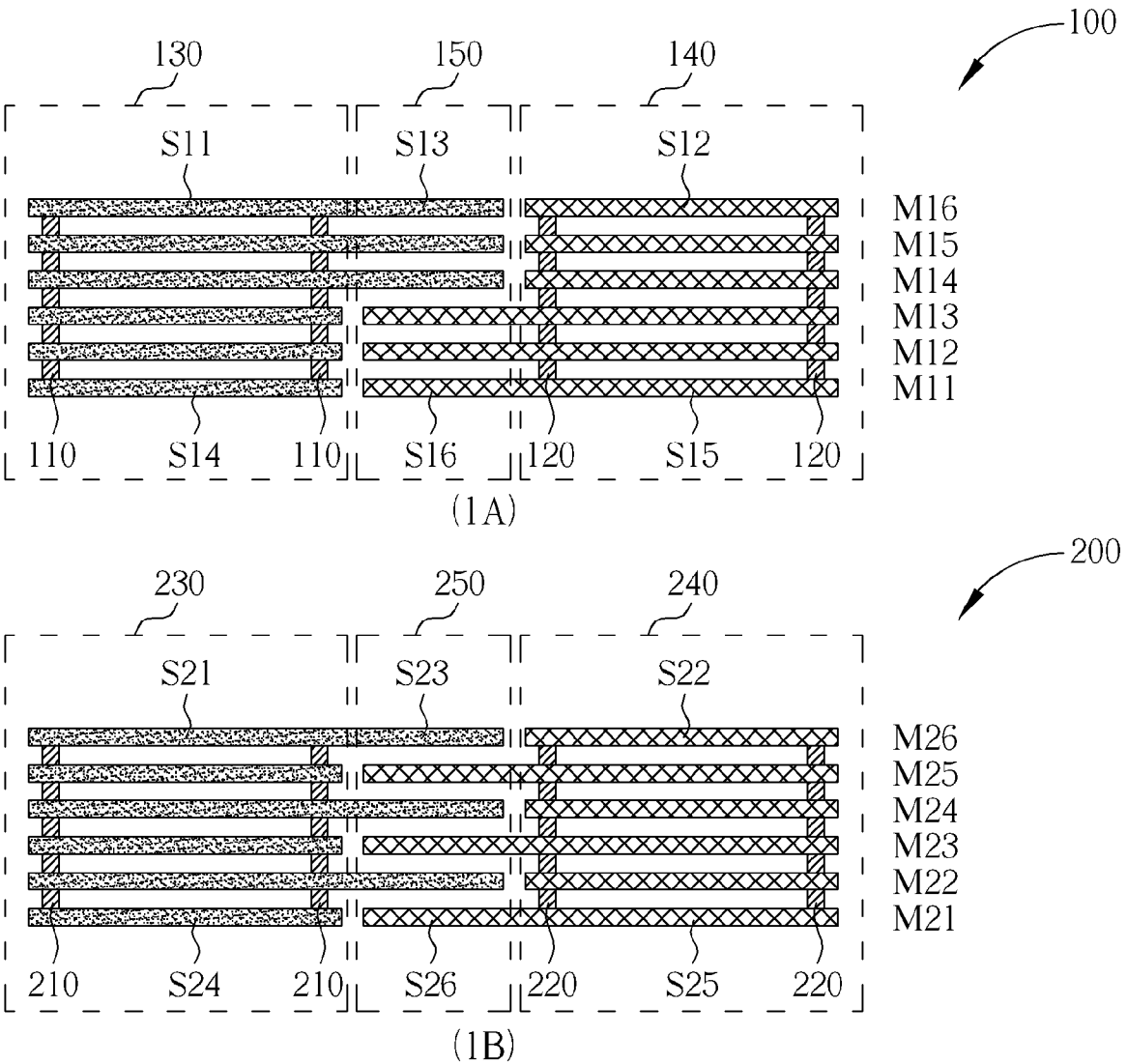
FIG. 1 (including 1A and 1B) is a diagram of stacked structures of a spiral inductor according to an embodiment of the present invention.

Please refer to FIG. 1. FIG. 1 (including 1A and 1B) is a diagram of stacked structures of a spiral inductor according to an embodiment of the present invention. Herein 1A represents an L-shape crossover structure, and 1B represents an interdigitated crossover structure. In this embodiment, both of the L-shape crossover structure shown in 1A and the interdigitated crossover structure shown in 1B are applied to a symmetric spiral inductor. As shown in 1A, the stacked structure of a spiral inductor 100 consists of six metal layers M16~M11, a first set of vias 110, and a second set of vias 120. The metal layers M16~M14 respectively have segments S11, S12, and S13, wherein the segment S13 is connected to the segment S11 and is positioned between the segment S11 and the segment S12. The metal layers M13~M11 are positioned under the metal layers M16~M14. The metal layers M13~M11 respectively have segments S14, S15, and S16, wherein the segment S16 is connected to the segment S15 and is positioned between the segment S14 and the segment S15. Moreover, the first set of vias 110 connects the segment S11 with the segment S14, while the second set of vias 120 connects the segment S12 with the segment S15. Be noted that in this embodiment, the segment S11 of the metal layers M16~M14, the segment S14 of the metal layers M13~M11, together with the first set of vias 110 construct a first shunt winding 130 of the spiral inductor 100; the segment S12 of the metal layers M16~M14, the segment S15 of the metal layers M13~M11, together with the second set of vias 120 construct a second shunt winding 140 of the spiral inductor 100; and the segment S13 of the metal layers M16~M14 together with the segment S16 of the metal layers M13-M11 construct a crossover region 150.

As shown in 1B, the stacked structure of a spiral inductor 200 consists of six metal layers M26~M21, a first set of vias 210, and a second set of vias 220. The metal layers M26, M24, and M22 respectively have segments S21, S22, and S23, wherein the segment S23 is connected to the segment S21 and is positioned between the segment S21 and the segment S22. The metal layers M25, M23, and M21 respectively have segments S24, S25, and S26, wherein the segment S26 is connected to the segment S25 and is positioned between the segment S24 and the segment S25. Moreover, the first set of vias 210 connects the segment S21 with the segment S24, while the second set of vias 220 connects the segment S22 with the segment S25. Be noted that in this embodiment, the segment S21 of the metal layers M26, M24, and M22, the segment S24 of the metal layers M25, M23, and M21, together with the first set of vias 210 construct a first shunt winding 230 of the spiral inductor 200; the segment S22 of the metal layers M26, M24, and M22, the segment S25 of the metal layers M25, M23, and M21, together with the second set of vias 220 construct a second shunt winding 240 of the spiral inductor 200; and the segment S23 of the metal layers M26, M24, and M22 together with the segment S26 of the metal layers M25, M23, and M21 construct a crossover region 250.

Please note that in the abovementioned embodiment, six metal layers are cited as an example for illustration. However, this is not meant to be limitations of the scope of the present invention, and the number of the metal layers is not limited.

Figure 2:
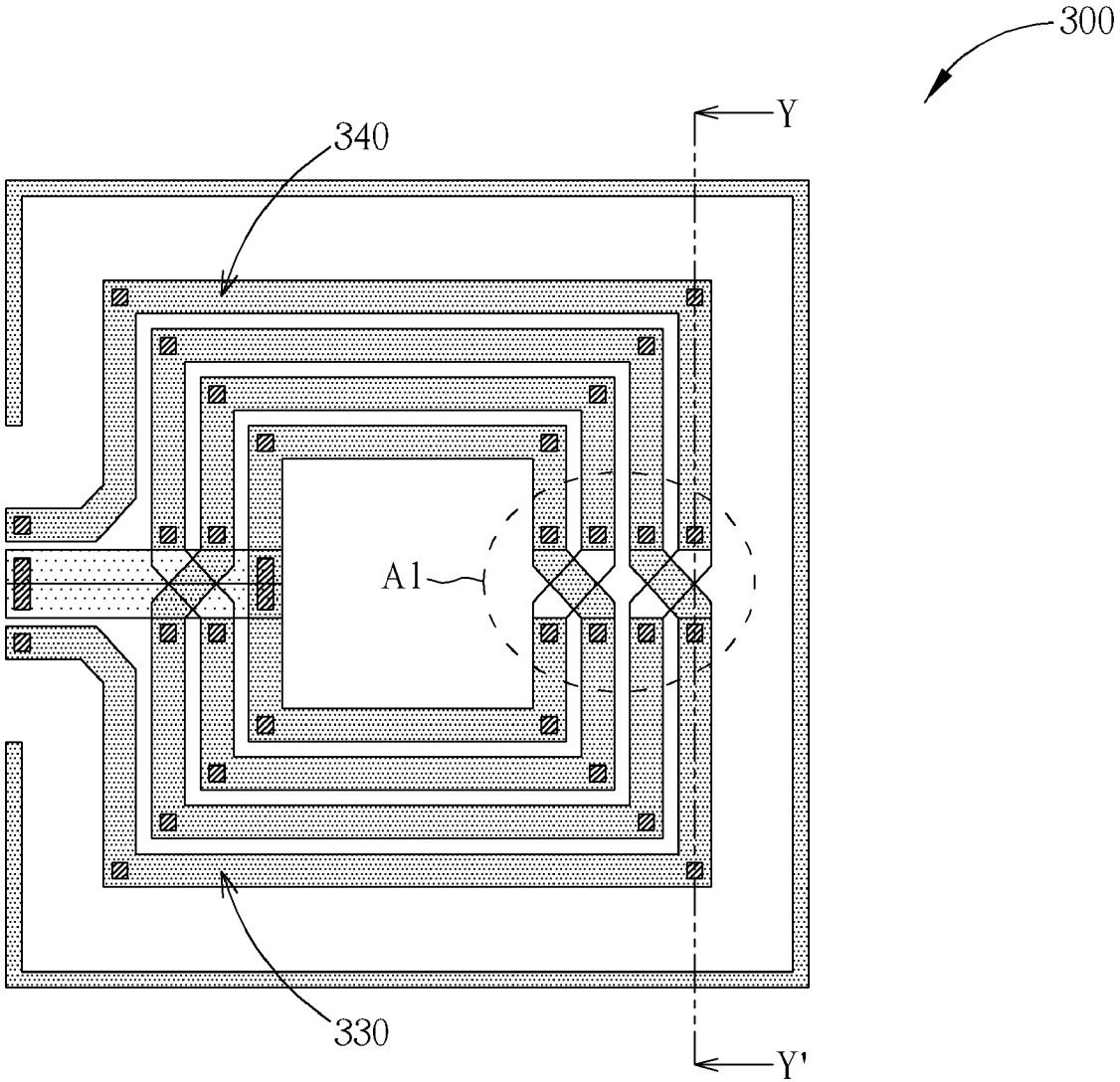
FIG. 2 is a top view diagram showing an exemplary embodiment of a symmetric spiral inductor.
Figure 3:
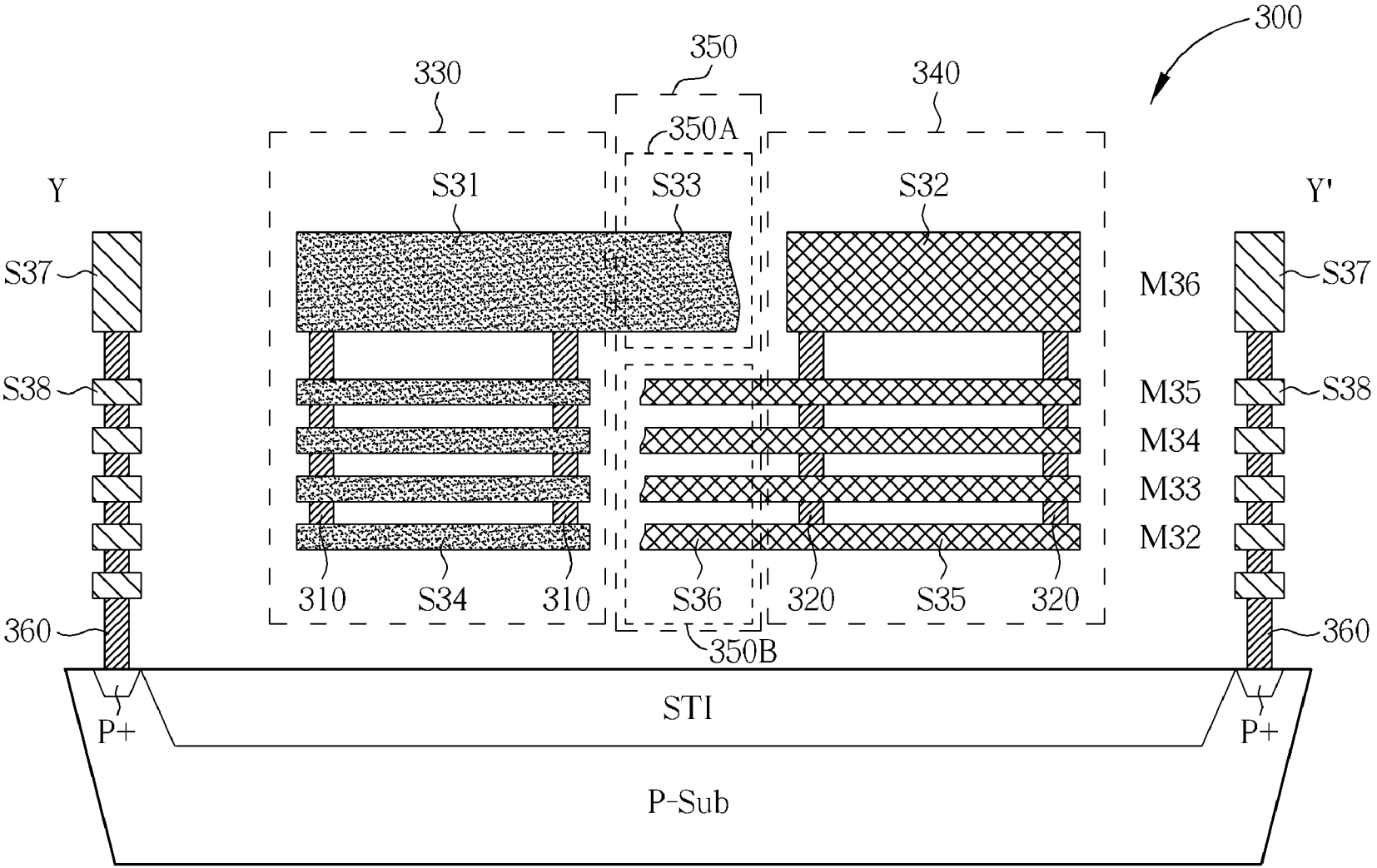
FIG. 3 is a longitudinal section view of the symmetric spiral inductor shown in FIG. 2 adopting the first stacked structure of 1A.
Figure 4:
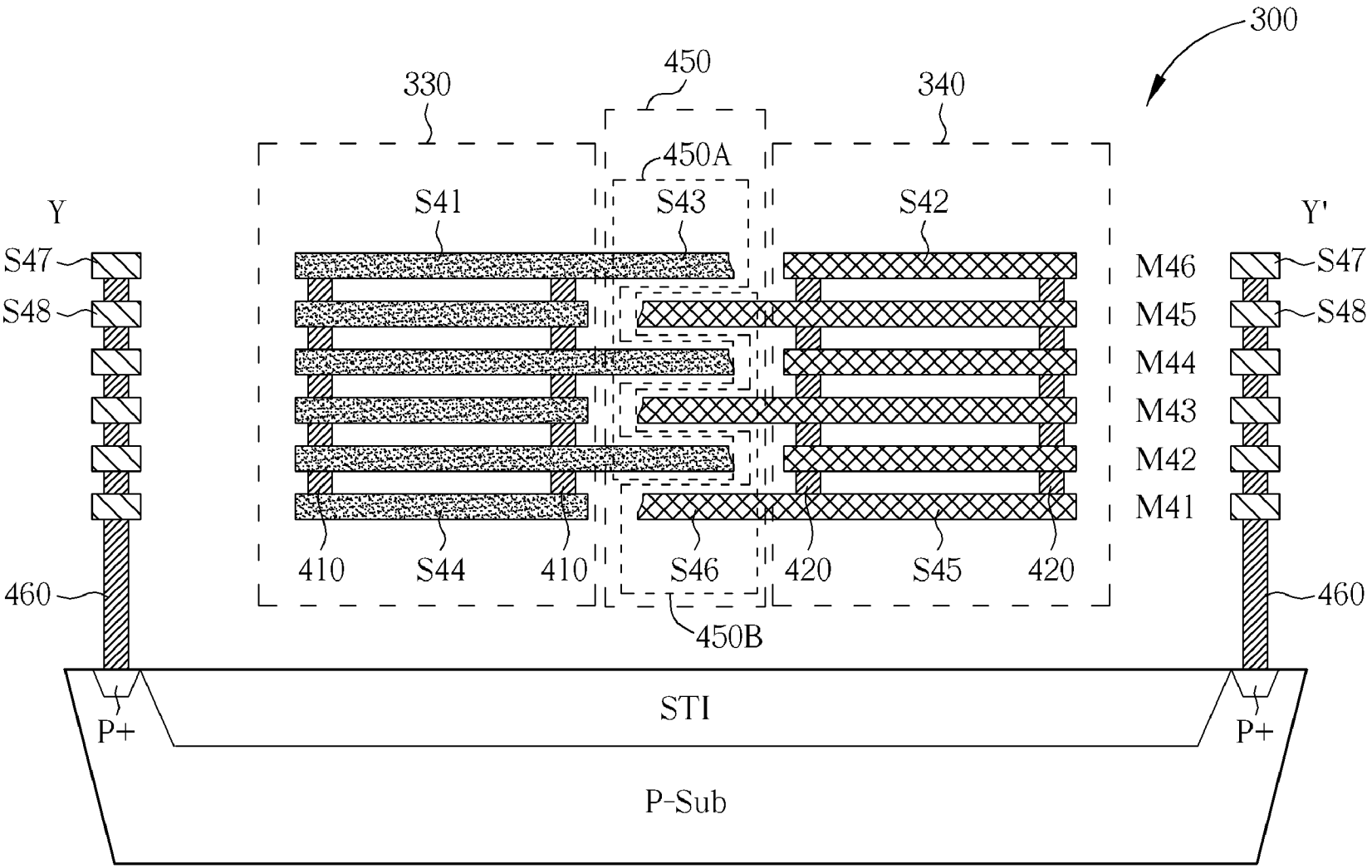
FIG. 4 is a longitudinal section view of the symmetric spiral inductor shown in FIG. 2 adopting the second stacked structure of 1B.

Please refer to FIG. 2, FIG. 3, together with FIG. 4. FIG. 2 is a top view diagram showing an exemplary embodiment of a symmetric spiral inductor 300; FIG. 3 is a longitudinal section view of the symmetric spiral inductor 300 shown in FIG. 2 adopting the first stacked structure of 1A; and FIG. 4 is a longitudinal section view of the symmetric spiral inductor 300 shown in FIG. 2 adopting the second stacked structure of 1B. From FIG. 2, we can see that the symmetric spiral inductor 300 consists of a first shunt winding 330 and a second shunt winding 340, and an area marked with A1 represents a crossover region. In addition, FIG. 3 shows a longitudinal section view of the symmetric spiral inductor 300 along the dotted line YY' shown in FIG. 2, which adopts the first stacked structure of 1A. As FIG. 3 depicts, the stacked structure of the symmetric inductor 300 includes five metal layers M36~M32, a first set of vias 310, and a second set of vias 320. Be noted that in this embodiment, a segment S31 of the metal layer M36, a segment S34 of the metal layers M35~M32, together with the first set of vias 310 construct the first shunt winding 330 of the symmetric spiral inductor 300; a segment S32 of the metal layer M36, a segment S35 of the metal layers M35~M32, together with the second set of vias 320 construct the second shunt winding 340 of the spiral inductor 300; and a segment S33 of the metal layer M36 together with a segment S36 of the metal layers M35~M32 construct a crossover region 350 (including a first portion 350A and a second portion 350B). As can be known from FIG. 2 and FIG. 3, a layout direction of the segment S33 (used for constructing the first portion 350A of the crossover region 350) is different from a layout direction of the segment S31 and a layout direction of the segment S32; and a layout direction of the segment S36 (used for constructing the second portion 350B of the crossover region 350) is different from a layout direction of the segment S34 and a layout direction of the segment S35 as well.

What is more, the metal layer M36 further includes a first guard ring segment S37 disposed at the outer side of the segment S31 and/or the outer side of the segment S32; the metal layers M35~M32 further includes a second guard ring segment S38 disposed at the outer side of the segment S34 and/or the outer side of the segment S35; and the stacked structure further includes a third set of vias 360 for connecting the first guard ring segment S37 with the second guard ring segment S38. Herein the first guard ring segment S37, the second guard ring segment S38, together with the third set of vias 360 construct a stacked guard ring, such that noise-blocking ability can be improved.

Please note that in this embodiment, since a thickness of the metal layer M36 is greater than a thickness of the metal layers M35~M32, the first portion 350A of the crossover region 350 is implemented by adopting a single metal layer (namely, the segment S33 of the metal layer M36), and the second portion 350B of the crossover region 350 is implemented by adopting multiple stacked metal layers (namely, the segment S36 of the metal layers M35~M32) Furthermore, all of the metal layers M35~M32 are positioned under the metal layer M36 with a view to the inductor symmetry.

FIG. 4 shows a longitudinal section view of the symmetric spiral inductor 300 along the dotted line YY' shown in FIG. 2, which adopts the second stacked structure of 1B. As FIG. 4 depicts, the stacked structure of the symmetric inductor 300 includes six metal layers M46~M41, a first set of vias 410, and a second set of vias 420. Be noted that in this embodiment, a segment S41 of the metal layers M46, M44, and M42, a segment S44 of the metal layers M45, M43, and M41, together with the first set of vias 410 construct the first shunt winding 330 of the symmetric spiral inductor 300; a segment S42 of the metal layers M46, M44, and M42, a segment S45 of the metal layers M45, M43, and M41, together with the second set of vias 420 construct the second shunt winding 340 of the spiral inductor 300; and a segment S43 of the metal layers M46, M44, and M42 together with a segment S46 of the metal layers M45, M43, and M41 construct a crossover region 450 (including a first portion 450A and a second portion 450B). As can be known from FIG. 2 and FIG. 4, a layout direction of the segment S43 (used for constructing the first portion 450A of the crossover region 450) is different from a layout direction of the segment S41 and a layout direction of the segment S42; and a layout direction of the segment S46 (used for constructing the second portion 450B of the crossover region 450) is different from a layout direction of the segment S44 and a layout direction of the segment S45 as well.

What's more, the metal layers M46, M44, and M42 further include a first guard ring segment S47 disposed at the outer side of the segment S41 and/or the outer side of the segment S42; the metal layers M45, M43, and M41 further include a second guard ring segment S48 disposed at the outer side of the segment S44 and/or the outer side of the segment S45; and the stacked structure further includes a third set of vias 460 for connecting the first guard ring segment S47 with the second guard ring segment S48. Herein the first guard ring segment S47, the second guard ring segment S48, together with the third set of vias 460 construct a stacked guard ring, such that noise-blocking ability can be improved.

Please note that in this embodiment, since a thickness of the metal layer M46/M44/M42 is equal to a thickness of the metal layer M45/M43/M41, the first portion 450A of the crossover region 450 is implemented by adopting multiple stacked metal layers (namely, the segment S43 of the metal layers M46, M44, and M42), and the second portion 450B of the crossover region 450 is implemented by adopting multiple stacked metal layers (namely, the segment S46 of the metal layers M45, M43, and M41) as well. Furthermore, the metal layers M46, M44, and M42 and the metal layers M45, M43, and M41 are interlaced with a view to the inductor symmetry.

From what has been discussed in FIG. 3 and FIG. 4 above, we can see that the layout manner of the spiral inductor disclosed in the present invention can increase the inductor symmetry by reference to the thickness of the metal layers. As an illustration, if the thickness of the metal layers within the integrated circuit are different from each other, the "L-shape crossover structure" (i.e., the crossover structure shown in 1A of FIG. 1 or FIG. 3) can be adopted in layout with a view to an optimum inductor symmetry. In addition, if the thickness of each metal layer within the integrated circuit are identical to each other, the "interdigitated crossover structure" (i.e., the crossover structure shown in 1B of FIG. 1 or FIG. 4) can be adopted in layout with a view to an optimum inductor symmetry.

As can be known from the embodiments above, the stacked structure of the spiral inductor disclosed in the present invention is capable of optimizing a quality factor of the inductor by making use of metal layers of the crossover region as shunt windings. As a result, parasitic resistors of the spiral inductor won't be restricted by a conductivity of the crossover region, a number of the vias, and resistance of the vias.

Figure 5:
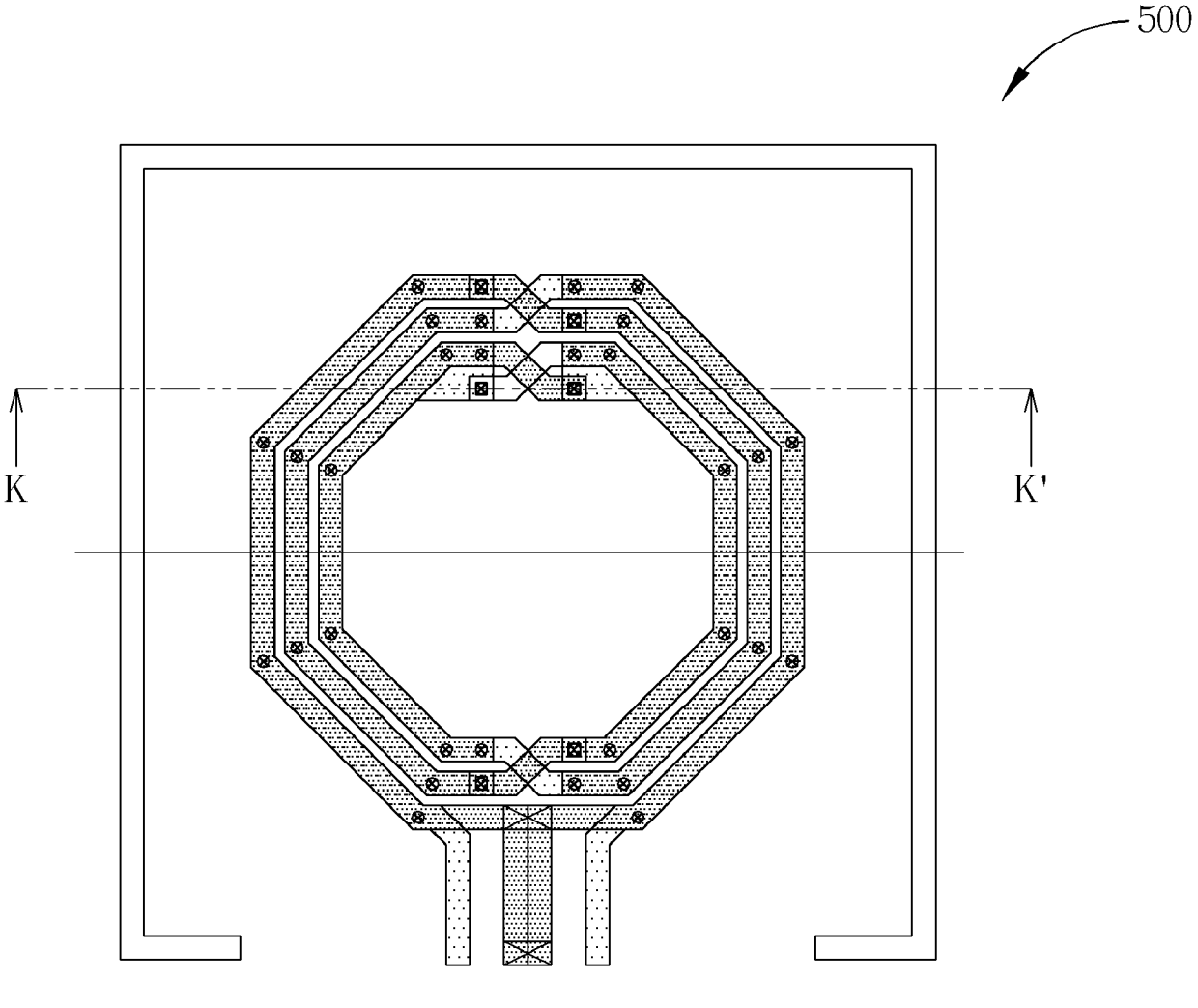
FIG. 5 is a top view diagram showing an exemplary embodiment of a symmetric spiral inductor combining a serial winding with a shunt winding.
Figure 6:
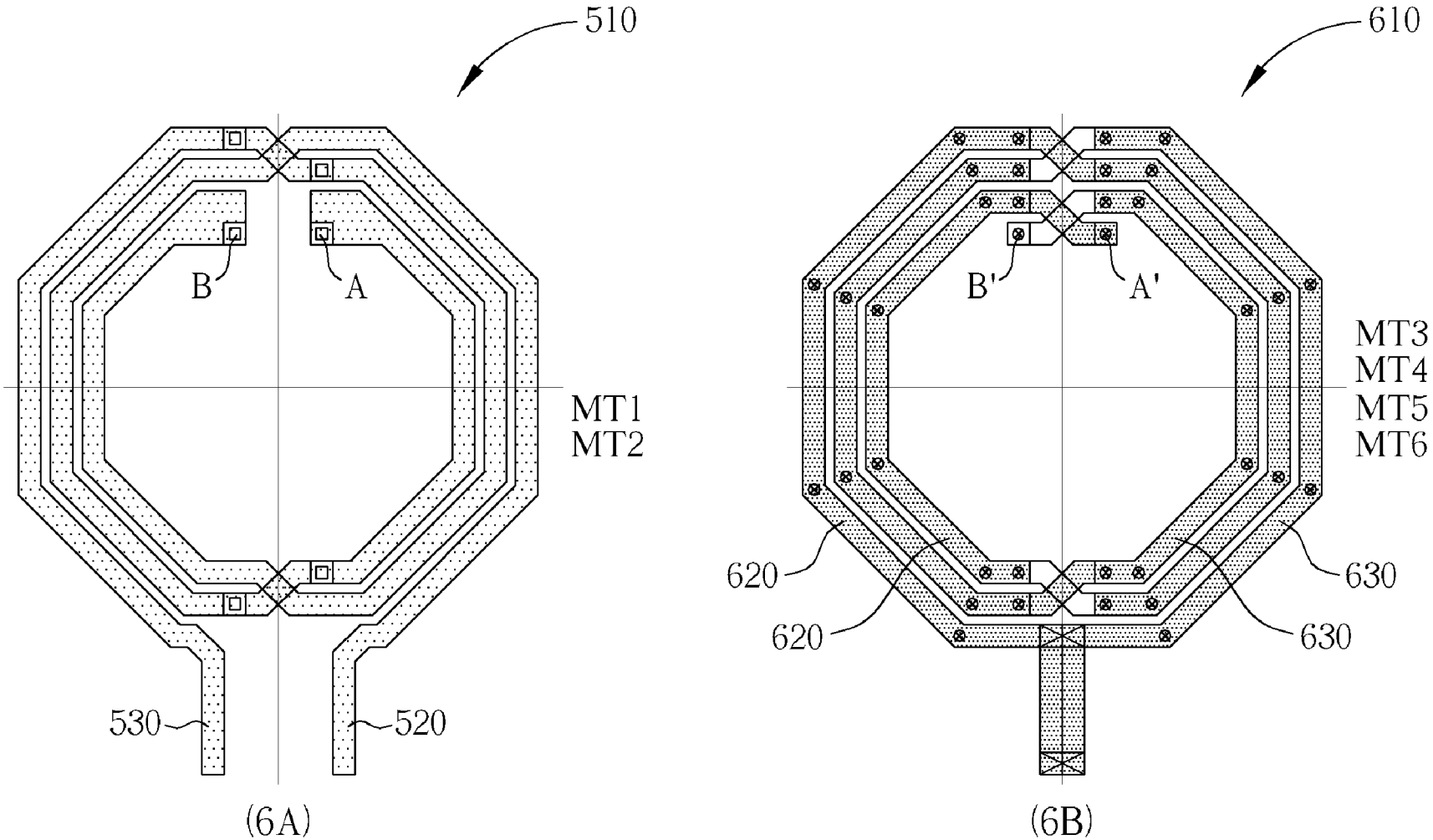
FIG. 6 (including 6A and 6B) is a diagram illustrating the serial winding and the shunt winding of the symmetric spiral inductor shown in FIG. 5.

Please refer to FIG. 5 together with FIG. 6. FIG. 5 is a top view diagram showing an exemplary embodiment of a symmetric spiral inductor 500 combining a serial winding with a shunt winding, and FIG. 6 (including 6A and 6B) is a diagram illustrating a first inductor 510 (as is shown in 6A) and a second inductor 610 (as is shown in 6B) of the symmetric spiral inductor 500 shown in FIG. 5. The symmetric spiral inductor 500 is a multi-layer stacked spiral inductor combining the first inductor 510 (i.e., the serial winding) with the second inductor 610 (i.e., the shunt winding), such that the series inductance under the same area can be increased in order to improve the usage of chip area. As shown in 6A, the first inductor 510 may be a traditional single-layer symmetric inductor, which adopts a metal layer MT1 as the winding and adopts another metal layer MT2 as the crossover region. Herein the center taps of the first inductor 510 are used as the joints A and B of the first serial winding 520 and the second serial winding 530, and the joints A and B can be disconnected so as to connect with the center taps of the second inductor 610 (namely, the joints A' and B' of the first shunt winding 620 and the second shunt winding 630). On the other hand, the second inductor 610 shown in 6B can be implemented by adopting the first stacked structure of 1A (i.e., the L-shape crossover structure) or the second stacked structure of 1B (i.e., the interdigitated crossover structure). The second inductor 610 uses metal layers MT13, MT4, MT5, and MT6 as the winding and the crossover region, wherein the metal layers MT1, MT2, MT3, MT4, MT5, and MT6 are parallel to each other from top to bottom.

Figure 7:
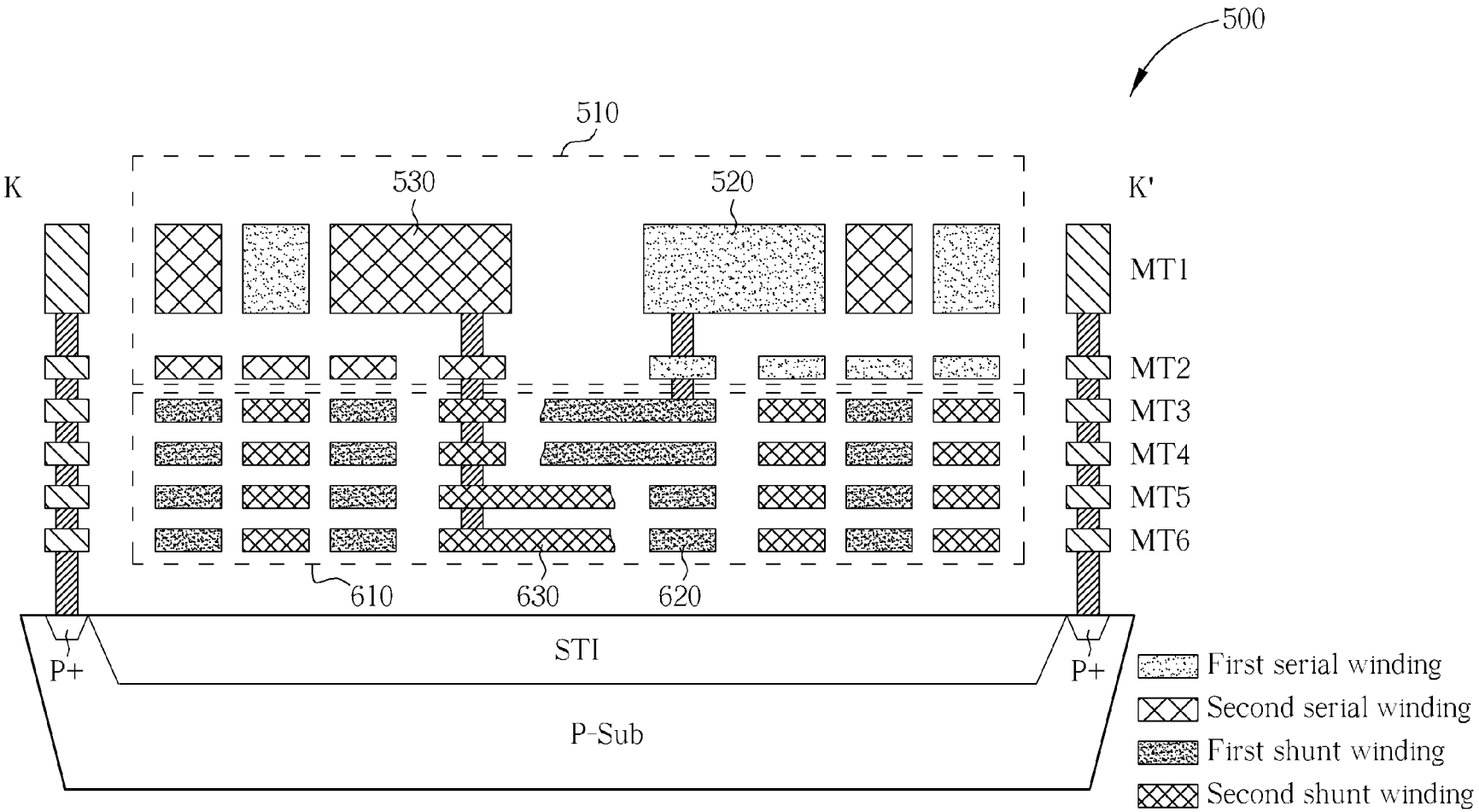
FIG. 7 is a transverse section view of the symmetric spiral inductor shown in FIG. 5 adopting the first stacked structure of 1A.

Please refer to FIG. 7. FIG. 7 is a transverse section view of the symmetric spiral inductor 500 shown in FIG. 5 along the dotted line KK', which is implemented by adopting the first stacked structure of 1A. As FIG. 7 depicts, the symmetric spiral inductor 500 consists of the first inductor 510 and the second inductor 610. In this embodiment, the first inductor 510 adopts the metal layer MT1 as the windings (including the first serial winding 520 and the second serial winding 530), and adopts the metal layer MT2 as the crossover region. The second inductor 610 is implemented by adopting the L-shape crossover structure shown in 1A of FIG. 1, wherein the metal layers MT3 and MT4 can correspond to the metal layers M16~M14 shown in 1A of FIG. 1, and the metal layers MT5 and MT6 can correspond to the metal layers M13~M11 shown in 1A of FIG. 1.

Figure 8:
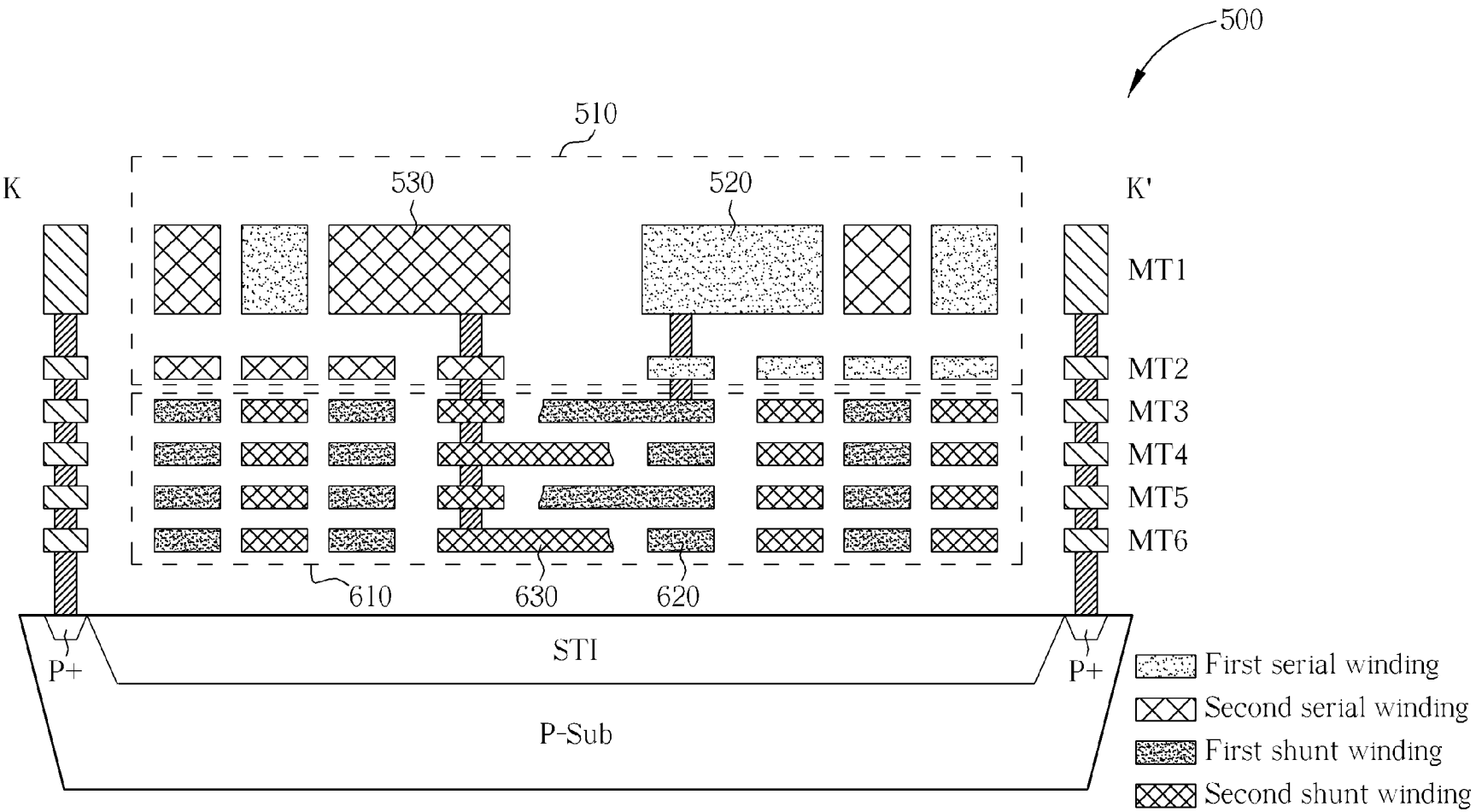
FIG. 8 is a transverse section view of the symmetric spiral inductor shown in FIG. 5 adopting the second stacked structure of 1B.

Please refer to FIG. 8. FIG. 8 is a transverse section view of the symmetric spiral inductor 500 shown in FIG. 5 along the dotted line KK', which is implemented by adopting the second stacked structure of 1B. As FIG. 8 depicts, the symmetric spiral inductor 500 consists of the first inductor 510 and the second inductor 610. In this embodiment, the second inductor 610 is implemented by adopting the interdigitated crossover structure shown in 1B of FIG. 1, wherein the metal layers MT3 and MT5 can correspond to the metal layers M26, M24, and M22 shown in 1B of FIG. 1, and the metal layers MT4 and MT6 can correspond to the metal layers M25, M23, and M21 shown in 1B of FIG. 1.

Figure 9:
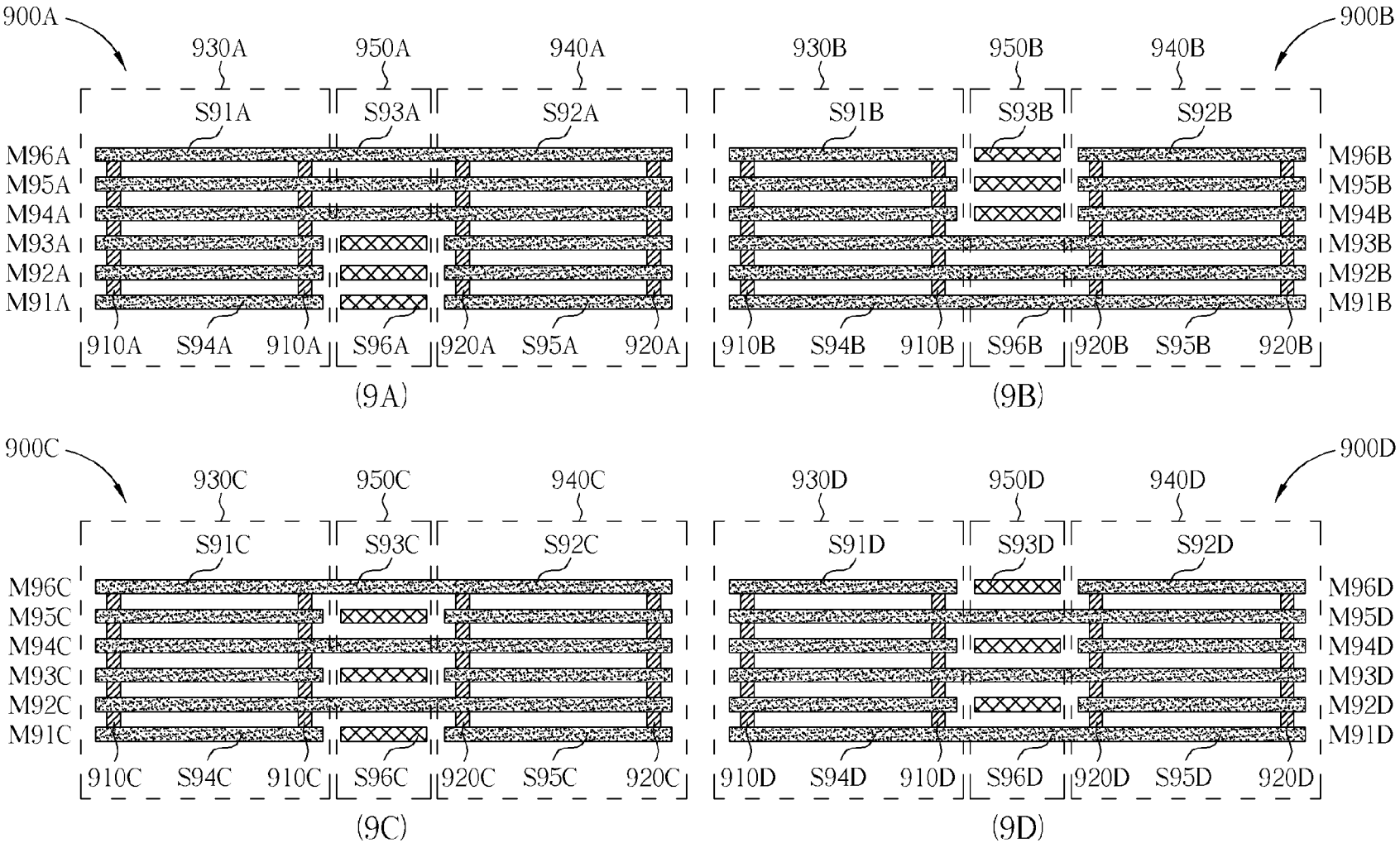
FIG. 9 (including 9A, 9B, 9C and 9D) is a diagram of stacked structures of a spiral inductor according to another embodiment of the present invention.

Please refer to FIG. 9. FIG. 9 (including 9A, 9B, 9C and 9D) is a diagram of stacked structures of a spiral inductor according to another embodiment of the present invention. Herein 9A and 9B represent a trench-shape crossover structure, 9C and 9D represent an interdigitated crossover structure. In this embodiment, all of the crossover structures shown in 9A, 9B, 9C, and 9D are applied to a non-symmetric spiral inductor. As shown in 9A, the first stacked structure of a spiral inductor 900A consists of six metal layers M96A~M91A, a first set of vias 910A, and a second set of vias 920A. The metal layers M96A~M94A respectively have segments S91A, S92A, and S93A, wherein the segment S93A is connected to the segment S91A and the segment S92A and is positioned between the segment S91A and the segment S92A. The metal layers M93A~M91A respectively have segments S94A, S95A, and S96A, wherein the segment S96A is positioned between the segment S94A and the segment S95A. Moreover, the first set of vias 910A connects the segment S91A and the segment S94A, while the second set of vias 920A connects the segment S92A and the segment S95A. Be noted that the segment S91A of the metal layers M96A~M94A, the segment S94A of the metal layers M93A~M91A, together with the first set of vias 910A construct a first shunt winding 930A of the spiral inductor 900A; the segment S92A of the metal layers M96A~M94A, the segment S95A of the metal layers M93A~M91A, together with the second set of vias 920A construct a second shunt winding 940A of the spiral inductor 900A; and the segment S93A together with the segment S96A construct a crossover region 950A. In addition, the second stacked structure of the spiral inductor 900B shown in 9B is similar to the first stacked structure of the spiral inductor 900A shown in 9A, and the difference between them is that the second stacked structure of the spiral inductor 900B is the inverse of the first stacked structure of the spiral inductor 900A. In other words, the metal layers M96A~M94A are positioned above the metal layers M93A~M91A in 9A, while the metal layers M93B~M91B are positioned under the metal layers M96B~M94B in 9B.

As shown in 9C, the third stacked structure of a spiral inductor 900C consists of six metal layers M96C~M91C, a first set of vias 910C, and a second set of vias 920C. The metal layers M96C, M94C, and M92C respectively have segments S91C, S92C, and S93C, wherein the segment S93C is connected to the segment S91C and the segment S92C and is positioned between the segment S91C and the segment S92C. The metal layers M95C, M93C, and M91C respectively have segments S94C, S95C, and S96C, wherein the segment S96C is positioned between the segment S94C and the segment S95C. Moreover, the first set of vias 910C connects the segment S91C and the segment S94C, while the second set of vias 920C connects the segment S92C and the segment S95C. Be noted that the segment S91C of the metal layers M96C, M94C, and M92C, the segment S94C of the metal layers M95C, M93C, and M91C, together with the first set of vias 910C construct a first shunt winding 930C of the spiral inductor 900C; the segment S92C of the metal layers M96C, M94C, and M92C, the segment S95C of the metal layers M95C, M93C, and M91C, together with the second set of vias 920C construct a second shunt winding 940C of the spiral inductor 900C; and the segment S93C of the metal layers M96C, M94C, and M92C together with the segment S96C of the metal layers M95C, M93C, and M91C construct a crossover region 950C. In addition, the fourth stacked structure of the spiral inductor 900D shown in 9D is similar to the third stacked structure of the spiral inductor 900C shown in 9C, and the difference between them is that the fourth stacked structure of the spiral inductor 900D is the inverse of the third stacked structure of the spiral inductor 900C.

Figure 10:
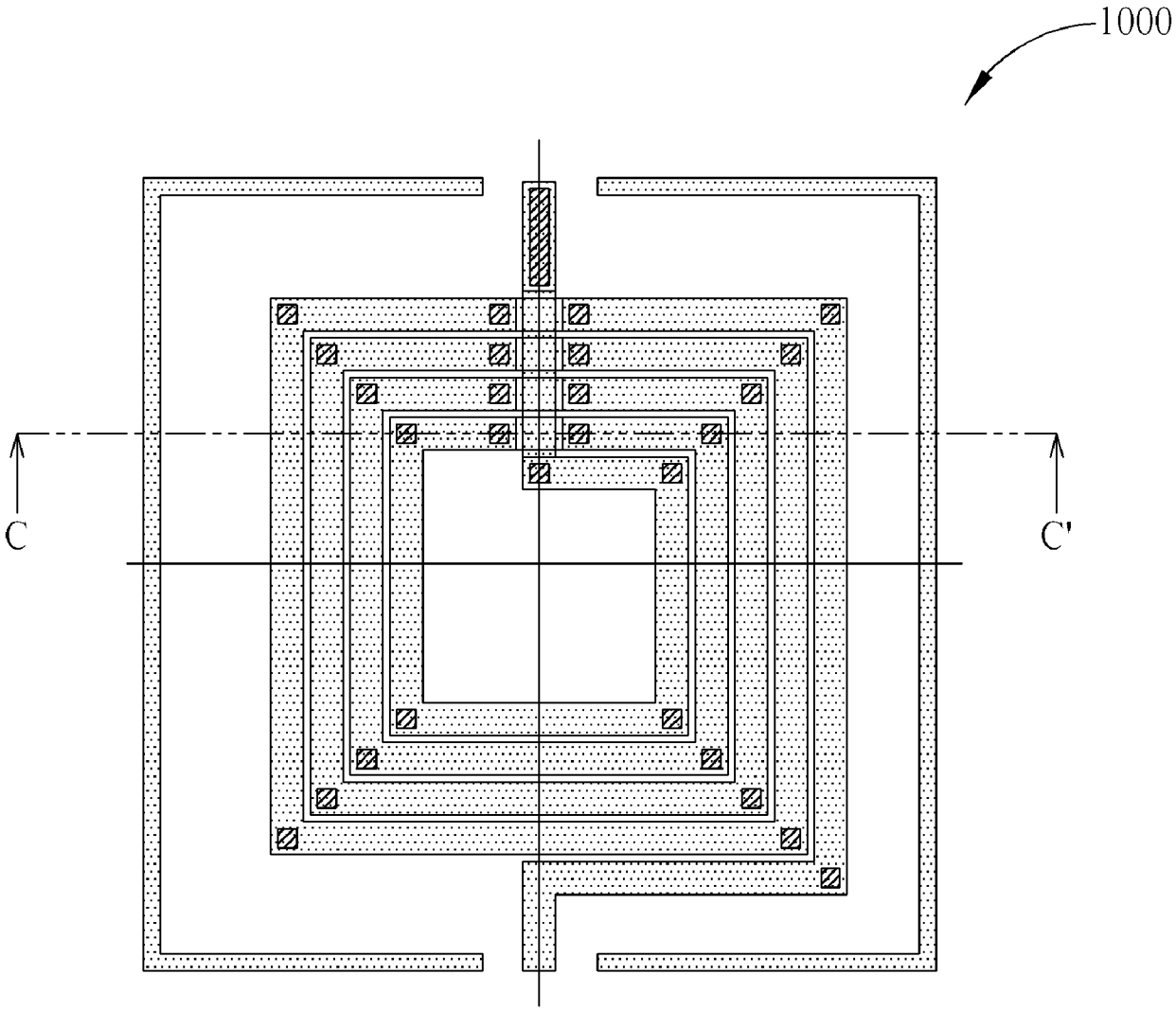
FIG. 10 is a top view diagram showing an exemplary embodiment of a non-symmetric spiral inductor.
Figure 11:
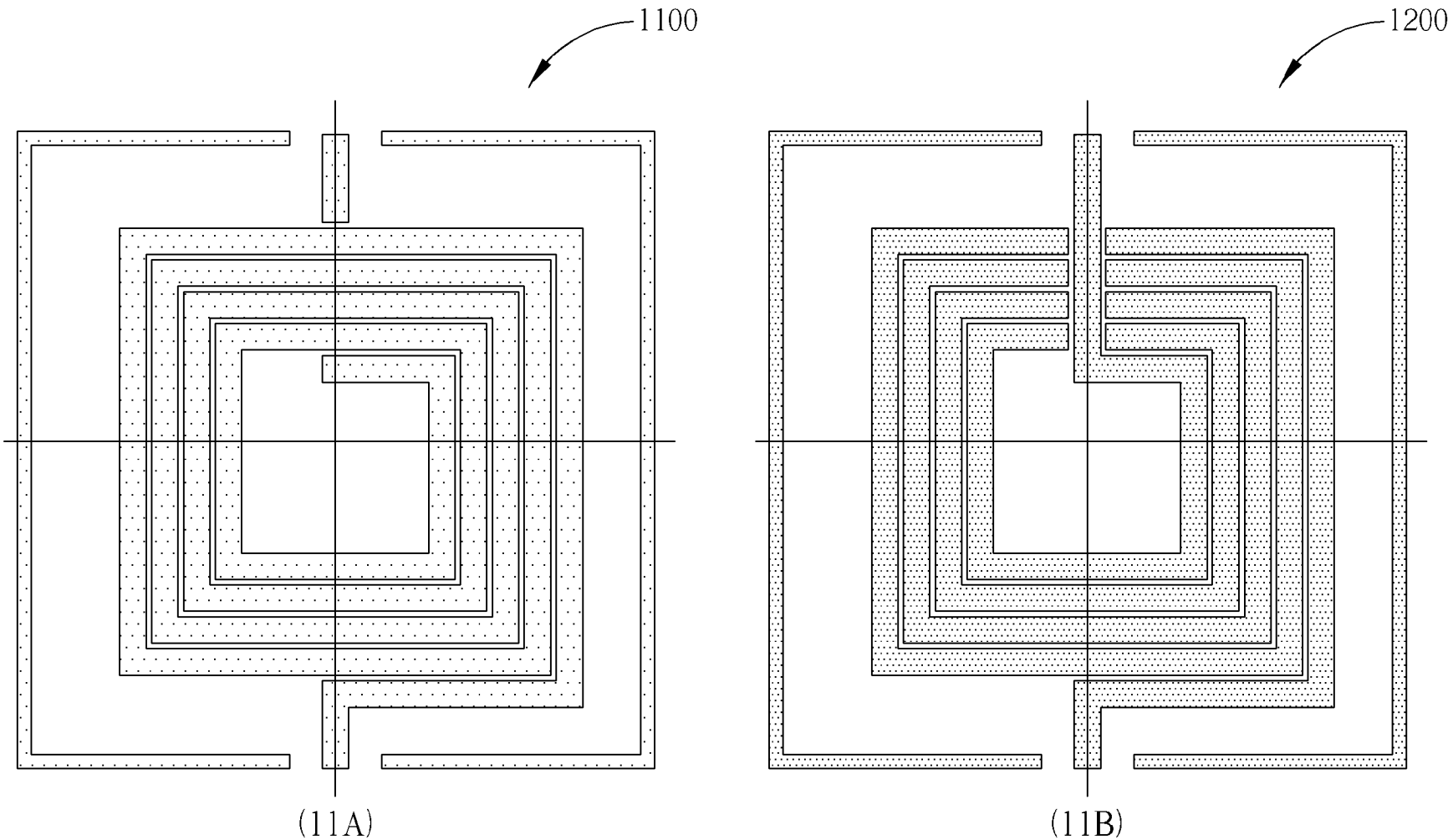
FIG. 11 (including 11A and 11B) is a diagram illustrating the first shunt winding and the second shunt winding of the non-symmetric spiral inductor shown in FIG. 10.

Please refer to FIG. 10 together with FIG. 11. FIG. 10 is a top view diagram showing an exemplary embodiment of a non-symmetric spiral inductor 1000, and FIG. 11 (including 11A and 11B) is a diagram illustrating the first shunt winding 1100 (as is shown in 11A) and the second shunt winding 1200 (as is shown in 11B) of the non-symmetric spiral inductor 1000 shown in FIG. 10.

Figure 12:
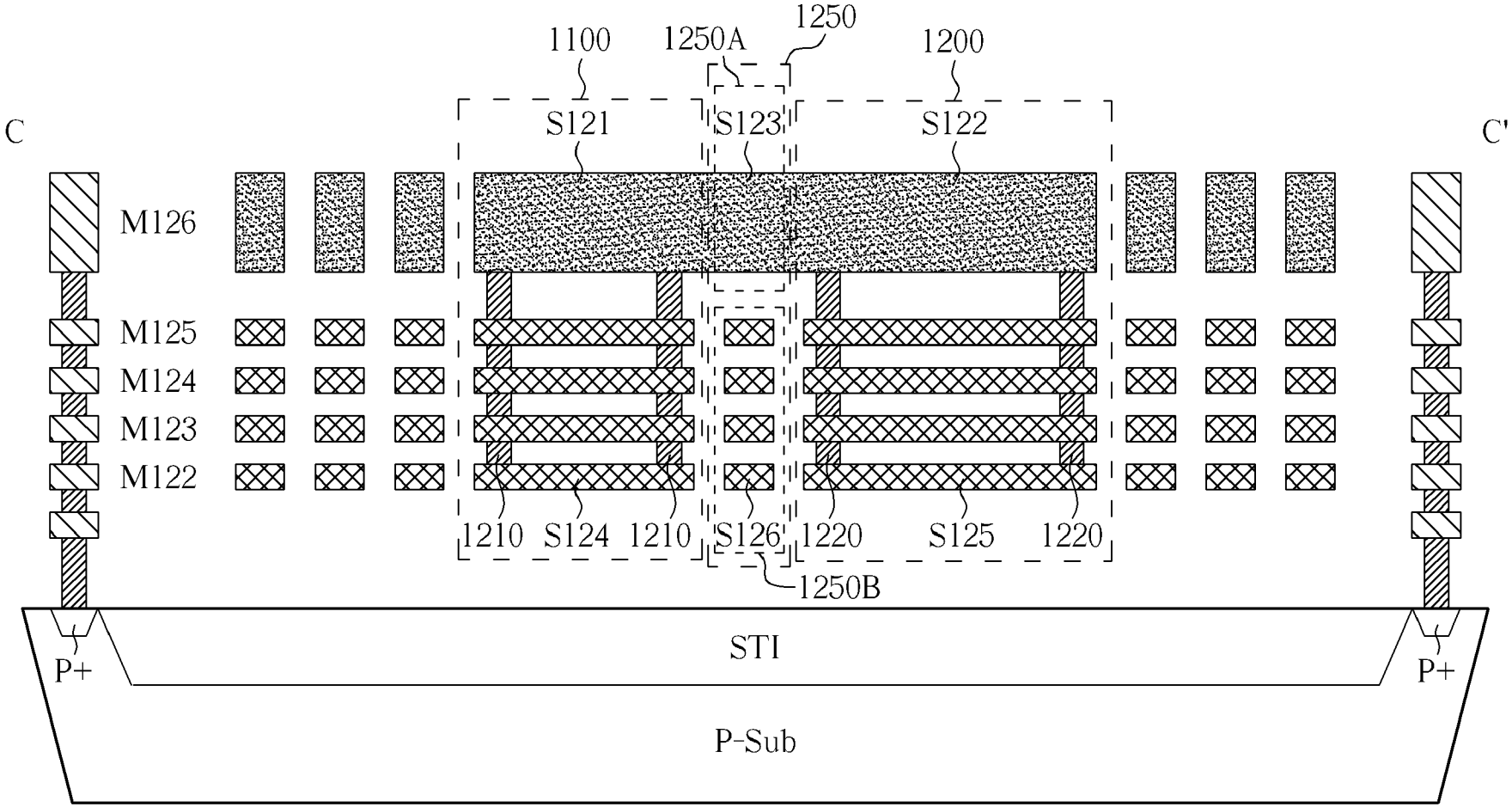
FIG. 12 is a transverse section view of the non-symmetric spiral inductor shown in FIG. 10 adopting the first stacked structure of 9A.

Please refer to FIG. 12. FIG. 12 is a transverse section view of the non-symmetric spiral inductor 1000 shown in FIG. 10 along the dotted line CC', which is implemented by adopting the first stacked structure of 9A. As FIG. 12 depicts, the stacked structure of the non-symmetric spiral inductor 1000 consists of five metal layers M126~M122, a first set of vias 1210, and a second set of vias 1220. In this embodiment, a segment S121 of the metal layer M126, a segment S124 of the metal layers M125~M122, together with the first set of vias 1210 construct a first shunt winding 1100 of the spiral inductor 1000; a segment S122 of the metal layer M126, a segment S125 of the metal layers M125~M122, together with the second set of vias 1220 construct a second shunt winding 1200; and a segment S123 of the metal layer M126 together with a segment S126 of the metal layers M125~M122 construct a crossover region 1250 (including a first portion 1250A and a second portion 1250B).

Please note that in this embodiment, since a thickness of the metal layer M126 is greater than a thickness of the metal layers M125~M122, the first portion 1250A of the crossover region 1250 is implemented by adopting a single metal layer (namely, the segment S123 of the metal layer M126), and the second portion 1250B of the crossover region 1250 is implemented by adopting multiple stacked metal layers (namely, the segment S126 of the metal layers M125~M122). Furthermore, all of the metal layers M125~M122 are positioned under the metal layer M126 with a view to the inductor symmetry.

Figure 13:
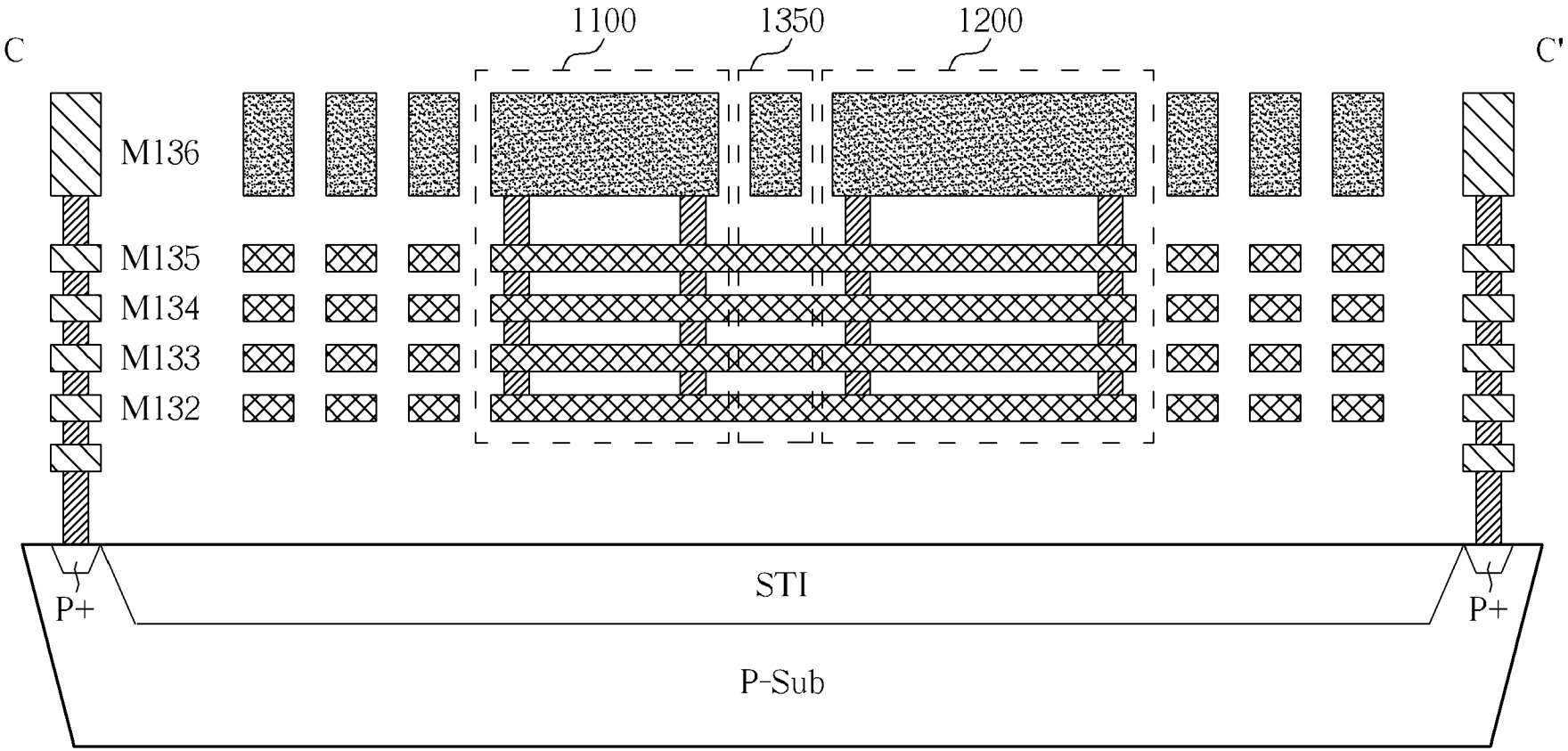
FIG. 13 is a transverse section view of the non-symmetric spiral inductor shown in FIG. 10 adopting the second stacked structure of 9B.

Please refer to FIG. 13. FIG. 13 is a transverse section view of the non-symmetric spiral inductor 1000 shown in FIG. 10 along the dotted line CC', which is implemented by adopting the second stacked structure of 9B. The stacked structure shown in FIG. 13 is similar to that shown in FIG. 12, and the difference between them is that the stacked structure shown in FIG. 13 is the inverse of the stacked structure shown in FIG. 12.

Figure 14:
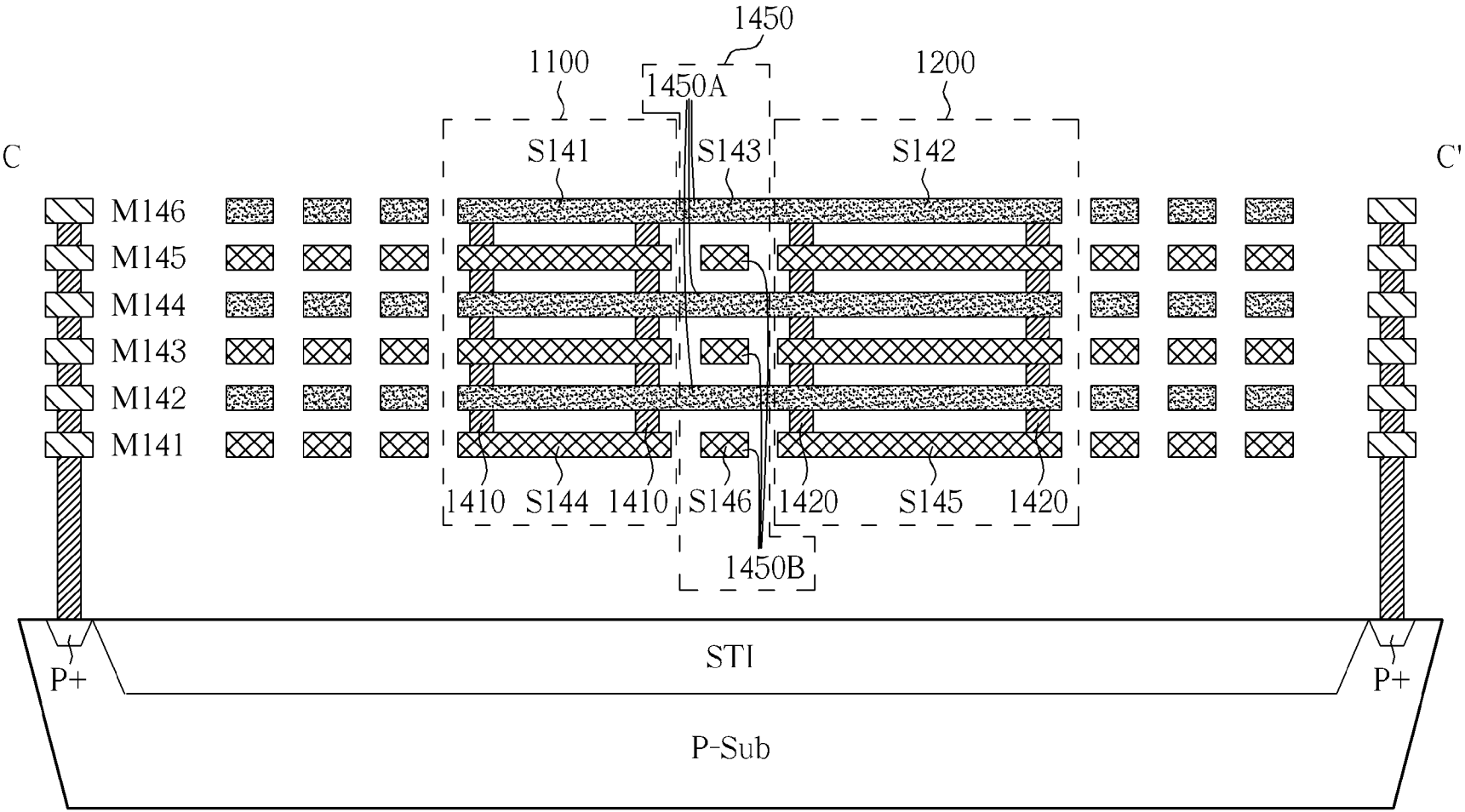
FIG. 14 is a transverse section view of the non-symmetric spiral inductor shown in FIG. 10 adopting the third stacked structure of 9C.

Please refer to FIG. 14. FIG. 14 is a transverse section view of the non-symmetric spiral inductor 1000 shown in FIG. 10 along the dotted line CC', which is implemented by adopting the third stacked structure of 9C. As FIG. 14 depicts, the stacked structure of the non-symmetric spiral inductor 1000 consists of six metal layers M146~M141, a first set of vias 1410, and a second set of vias 1420. In this embodiment, a segment S141 of the metal layers M146, M144, and M142, a segment S144 of the metal layers M145, M143, and M141, together with the first set of vias 1410 construct a first shunt winding 1100 of the spiral inductor 1000; a segment S142 of the metal layers M146, M144, and M142, a segment S145 of the metal layers M145, M143, and M141, together with the second set of vias 1420 construct a second shunt winding 1200; and a segment S143 of the metal layers M146, M144, and M142 together with a segment S146 of the metal layers M145, M143, and M141 construct a crossover region 1450 (including a first portion 1450A and a second portion 1450B).

Please note that in this embodiment, since a thickness of the metal layer M146/M144/M142 is equal to a thickness of the metal layer M145/M143/M141, the first portion 1450A of the crossover region 1450 is implemented by adopting multiple stacked metal layers (namely, the segment S143 of the metal layers M146, M144, and M142), and the second portion 1450B of the crossover region 1450 is implemented by adopting multiple stacked metal layers (namely, the segment S146 of the metal layers M145, M143, and M141) as well. Furthermore, the metal layers M146, M144, and M142 and the metal layers M145, M143, and M141 are interlaced with a view to the inductor symmetry. Certainly, the non-symmetric spiral inductor 1000 can be implemented by adopting the fourth stacked structure of 9D. Since the fourth stacked structure of 9D is the inverse of the stacked structure of FIG. 14, and further description is omitted here for brevity.

Certainly, the aforementioned stacked guard ring can be adopted for improving noise-blocking ability. Moreover, in the abovementioned embodiments, a rectangle and an octagon are cited as examples for the shape of the first shunt winding and the second shunt winding, but this is not meant to be a limitation of the present invention. That is, the stacked structure of the spiral inductor disclosed in the present invention is suitable for a variety of shapes.

The abovementioned embodiments are presented merely for describing the features of the present invention, and in no way should be considered to be limitations of the scope of the present invention. In summary, a stacked structure of a spiral inductor is provided in the present invention, such that the spiral inductor with multiple stacked metal layers can obtain an optimum quality factor by making use of metal layers of a crossover region as shunt windings. Furthermore, the stacked structure of the spiral inductor disclosed in the present invention has a wide range of applications, which can be applied to a symmetric inductor and a non-symmetric inductor. Additionally, in the light of metal layers with different thicknesses, various kinds of crossover structures are proposed with a view to the inductor symmetry. What's more, a stacked guard ring is further proposed in the present invention, such that noise-blocking ability can be improved.

Those skilled in the art will readily observe that numerous modifications and alterations of the device and method may be made while retaining the teachings of the invention.

What is claimed is:

1. A structure of a spiral inductor, comprising:
- a first metal layer, comprising:
  - a first segment;
  - a second segment; and
  - a third segment, connected to the first segment, wherein a layout direction of the third segment is different from a layout direction of the first segment and a layout direction of the second segment;
- a second metal layer, being positioned under the first metal layer,
  - the second metal layer comprising:
  - a fourth segment;
  - a fifth segment; and
  - a sixth segment, connected to the fifth segment, wherein a layout direction of the sixth segment is different from a layout direction of the fourth segment and a layout direction of the fifth segment;
- a first set of vias, for connecting the first segment with the fourth segment; and
- a second set of vias, for connecting the second segment with the fifth segment;
- wherein the first segment, the fourth segment and the first set of vias construct a first shunt winding; the second segment, the fifth segment and the second set of vias construct a second shunt winding; and the third segment and the sixth segment construct a crossover region.

2. The structure of the spiral inductor of claim 1, wherein the third segment is positioned between the first segment and the second segment; and the sixth segment is positioned between the fourth segment and the fifth segment.

3. The structure of the spiral inductor of claim 1, wherein a first thickness of the first metal layer is greater than a second thickness of the second metal layer.

4. The structure of the spiral inductor of claim 3, wherein the spiral inductor further comprises a third metal layer being positioned under the second metal layer, a structure of the third metal layer is the same as a structure of the second metal layer, and the first thickness of the first metal layer is greater than a third thickness of the third metal layer.

5. The structure of the spiral inductor of claim 1, wherein a first thickness of the first metal layer is equal to a second thickness of the second metal layer.

6. The structure of the spiral inductor of claim 1, wherein the spiral inductor further comprises:
- a third metal layer, being positioned under the second metal layer, and a structure of the third metal layer is the same as a structure of the first metal layer; and
- a fourth metal layer, being positioned under the third metal layer, and a structure of the fourth metal layer is the same as a structure of the second metal layer;
- wherein a seventh segment of the third metal layer, an eighth segment of the fourth metal layer, the third segment, and the sixth segment construct the crossover region; and the third segment, the sixth segment, the seventh segment, and the eighth segment construct an interdigitated crossover structure.

7. The structure of the spiral inductor of claim 1, wherein:
- the first metal layer further comprises a first guard ring segment, disposed at the outer side of the first segment or the outer side of the second segment;
- the second metal layer further comprises a second guard ring segment, disposed at the outer side of the fourth segment or the outer side of the fifth segment; and
- the stacked structure further comprises a third set of vias, for connecting the first guard ring segment with the second guard ring segment; wherein the first guard ring segment, the second guard ring segment, and the third set of vias construct a stacked guard ring.

8. The structure of the spiral inductor of claim 1, wherein the spiral inductor is a symmetric spiral inductor.

9. The structure of the spiral inductor of claim 1, wherein a shape of the first shunt winding and the second shunt winding is substantially a rectangle, an octagon, or a circle.

10. A structure of a spiral inductor, comprising:
- a first metal layer, comprising:
  - a first segment;
  - a second segment; and
  - a third segment, being connected to the first segment and the second segment, and being positioned between the first segment and the second segment;
- a second metal layer, comprising:
  - a fourth segment;
  - a fifth segment; and
  - a sixth segment, being positioned between the fourth segment and the fifth segment;
- a first set of vias, for connecting the first segment with the fourth segment; and
- a second set of vias, for connecting the second segment and the fifth segment;
- wherein the first segment and the fourth segment construct a first shunt winding; the second segment and the fifth segment construct a second shunt winding; and the third segment and the sixth segment construct a crossover region.

11. The structure of the spiral inductor of claim 10, wherein the second metal layer is positioned above the first metal layer.

12. The structure of the spiral inductor of claim 10, wherein the first metal layer is positioned above the second metal layer.

13. The structure of the spiral inductor of claim 10, wherein a first thickness of the first metal layer is greater than a second thickness of the second metal layer.

14. The structure of the spiral inductor of claim 13, wherein the spiral inductor further comprises a third metal layer; a structure of the third metal layer is the same as a structure of the second metal layer; both the third metal layer and the second metal layer are positioned above or under the first metal layer; and the first thickness of the first metal layer is greater than a third thickness of the third metal layer.

15. The structure of the spiral inductor of claim 10, wherein a first thickness of the first metal layer is equal to a second thickness of the second metal layer.

16. The structure of the spiral inductor of claim 10, wherein the spiral inductor further comprises:

a third metal layer, and a structure of the third metal layer is the same as a structure of the first metal layer; and a fourth metal layer, and a structure of the fourth metal layer is the same as a structure of the second metal layer;

wherein a seventh segment of the third metal layer, an eighth segment of the fourth metal layer, the third segment, and the sixth segment construct the crossover region; and the third segment, the sixth segment, the seventh segment, and the eighth segment construct an interdigitated crossover structure.

17. The structure of the spiral inductor of claim 10, wherein the second metal layer is positioned under the first metal layer; the third metal layer is positioned under the second metal layer; and the fourth metal layer is positioned under the third metal layer.

18. The structure of the spiral inductor of claim 16, wherein the first metal layer is positioned under the second metal layer; the fourth metal layer is positioned under the first metal layer; and the third metal layer is positioned under the fourth metal layer.

19. The structure of the spiral inductor of claim 10, wherein:

the first metal layer further comprises a first guard ring segment, disposed at the outer side of the first segment or the outer side of the second segment;

the second metal layer further comprises a second guard ring segment, disposed at the outer side of the fourth segment or the outer side of the fifth segment; and the stacked structure further comprises a third set of vias, for connecting the first guard ring segment with the second guard ring segment; wherein the first guard ring segment, the second guard ring segment, and the third set of vias construct a stacked guard ring.

20. The structure of the spiral inductor of claim 10, wherein the spiral inductor is a non-symmetric spiral inductor.

* * * * *